US009687718B1

(12) United States Patent
Sorenson

(10) Patent No.: US 9,687,718 B1
(45) **Date of Patent: *Jun. 27, 2017**

(54) SWING SPEED TRAINER

(71) Applicant: James W. Sorenson, Mt. Pleasant, IA (US)

(72) Inventor: James W. Sorenson, Mt. Pleasant, IA (US)

( * ) Notice: Subject to any disclaimer, the term of this patent is extended or adjusted under 35 U.S.C. 154(b) by 163 days.

This patent is subject to a terminal disclaimer.

(21) Appl. No.: 14/608,909

(22) Filed: Jan. 29, 2015

Related U.S. Application Data

(60) Continuation-in-part of application No. 13/863,759, filed on Apr. 16, 2013, which is a division of application No. 12/930,067, filed on Dec. 27, 2010, now Pat. No. 8,540,584.

(51) Int. Cl.
*A63B 69/38* (2006.01)
*A63B 69/00* (2006.01)

(52) U.S. Cl.
CPC ..... *A63B 69/385* (2013.01); *A63B 69/0084* (2013.01); *A63B 2209/08* (2013.01)

(58) Field of Classification Search
CPC .... A63B 69/38; A63B 69/385; A63B 69/0017
See application file for complete search history.

(56) References Cited

U.S. PATENT DOCUMENTS 847,066 A 3/1907 Hall
2,396,408 A 3/1946 Benecke
2,462,955 A 3/1949 Glancey
2,532,646 A 12/1950 Severin
2,950,115 A 8/1960 Hurdzan
3,113,782 A 12/1963 Guier
3,231,281 A 1/1966 Wallo
3,743,297 A 7/1973 Dennis
4,027,886 A 6/1977 Katsube
4,444,396 A 4/1984 Wendt
4,634,121 A 1/1987 Sasaki
4,794,905 A 1/1989 Woolard
4,809,975 A 3/1989 Lee
4,953,868 A 9/1990 Thompson et al.
4,982,963 A 1/1991 Fazio et al.
5,026,063 A 6/1991 Rhodes
5,083,790 A 1/1992 Wheatley
5,135,228 A 8/1992 Hawkins, Sr. et al.
D329,268 S 9/1992 Perry
5,249,803 A 10/1993 Giffin
5,306,010 A 4/1994 Choi
(Continued)

*Primary Examiner* — Raleigh W Chiu
(74) *Attorney, Agent, or Firm* — Frank J. Catalano; Gable Gotwals

(57) ABSTRACT

A tennis serve trainer mechanically encourages and causes the execution of a counter-intuitive hitting-up-on-the-ball service swing. The trainer has a straight shaft and a ball which can slide freely on the shaft between a tennis racquet grip on one end and a cap on the other. The ball is magnetically held against the grip until a threshold swing speed releases the ball. The magnetic force, the distance from the grip to the cap and the weight of the ball are coordinated so that the ball will strike the cap at the apex of the swing. At that moment, the arm is fully extended, the racquet head speed is accelerated to its maximum, the angle of attack is ideal, the ball and the racquet meet at the perfect impact point at the apex of the serve, and a snap in the racquet motion happens automatically at the top of the swing.

7 Claims, 7 Drawing Sheets

(56) References Cited

U.S. PATENT DOCUMENTS

| | | | |
|---|---|---|---|
| 5,316,306 | A | 5/1994 | Cody |
| 5,330,190 | A | 7/1994 | Oakley, Jr. |
| 5,330,193 | A | 7/1994 | Ijiri |
| 5,405,138 | A | 4/1995 | Duran |
| 5,577,966 | A | 11/1996 | Duran |
| 5,711,718 | A | 1/1998 | Mueller |
| D405,859 | S | 2/1999 | Thompson |
| D426,607 | S | 6/2000 | Wurster |
| D432,613 | S | 10/2000 | Lewallen, Jr. |
| 6,458,037 | B1 | 10/2002 | Dixon |
| 6,461,163 | B1 | 10/2002 | Gallagher et al. |
| D485,325 | S | 1/2004 | Rohan-Weaver |
| 6,786,841 | B1 | 9/2004 | Dixon |
| 6,955,610 | B1 | 10/2005 | Czaja et al. |
| 7,297,078 | B2 | 11/2007 | Libonati |
| 7,618,328 | B2 | 11/2009 | Davenport et al. |
| 7,922,595 | B2 | 4/2011 | Libonati |
| 2007/0155525 | A1 | 7/2007 | Davenport et al. |
| 2007/0178986 | A1 | 8/2007 | Leadbetter et al. |

SWING SPEED TRAINER

CROSS-REFERENCE TO RELATED APPLICATIONS

This application is a continuation-in-part application of pending U.S. patent application Ser. No. 13,863,759 filed Apr. 16, 2013, which is a divisional application which claims priority to U.S. application Ser. No. 12/930,067 filed Dec. 27, 2010, which issued as U.S. Pat. No. 8,540,584.

BACKGROUND OF THE INVENTION

This invention relates generally to athletic training equipment and more particularly concerns a trainer which, having been swung by an athlete during practice swings, enables the athlete to significantly increase the athlete's swing speed with a conventional golf club, baseball bat, tennis racquet or other ball-striking implement.

Analysis of any athletic swing, such as a golf swing, a baseball swing or a tennis swing, can be broken down into several components which must be properly coordinated at the point of impact of the striking or propelling instrument with the projectile. These swing components generally include the swing plane, axial rotation and contact point speed of the projectile striking or propelling instrument and this invention is directed primarily to the achievement of maximum instrument contact point speed at the moment of impact.

In sports such as baseball and tennis, increased bat and racquet speeds translate into higher ball velocity. This leaves opponents less time for defensive reactions and offensively permits quicker swings which allow hitting faster pitches and returning higher velocity shots. In sports likes baseball and golf, where ball travel distance is of special importance, increased bat and club-head speeds translate into longer hits and shots. In baseball, for every mph increase in bat speed, the ball will travel approximately 2.5 feet further. A 10 mph increase in swing speed would add about 25 feet to ball travel, turning many easy outs into home runs. In golf, for every mph increase in club-head speed, the ball will travel approximately three yards further. A 10 mph increase in swing speed would add about 30 yards to a shot, resulting in a two or three club difference in club selection.

The importance of increased swing speed is so well known that many devices have been developed for the purpose of allowing an athlete to more consistently deliver a maximum swing speed at the point of contact by reason of performing a proper swing technique. Some devices produce an audible response to either a proper or an improper performance of a specific technique or exercise, depending on whether the device is intended to promote what is correct or to discourage what is incorrect. Other devices incorporate structural components which force an athlete to swing in a predetermined path or which contact the athlete's body during a swing to indicate the position of the instrument in relation to the athlete's body at one or more points along the swing. Still other devices are weighted in a manner intended to increase the strength of swing related muscles. One device uses a large diameter rigid tubular shaft with holes through its lower end which cause a whistling sound while yet another uses an extremely flexible corrugated tubular shaft to emit a high-pitch tone when the devices are properly swung.

Unfortunately, these known devices are designed to force or confirm the proper performance of an athletic swing at conventional or game condition speeds. Therefore, while they promote incrementally small improvements in swing speed, they do not train or enable the athlete to perform an athletic swing at speeds greatly in excess of, for example in the order of 30-40% faster than, the athlete's normal swing speed with a conventional club.

It is, therefore, an object of this invention to provide an athletic swing trainer which can be swung by an athlete at speeds greatly in excess of the athlete's normal swing speed under game conditions. It is also an object of this invention to provide an athletic swing trainer which affords a confirming signal to the athlete that the trainer has been swung by an athlete at speeds greatly in excess of the athlete's normal swing speed under game conditions. It is a further object of this invention to provide an athletic swing trainer which enables an athlete to transfer the high speed experience of practice athletic swings with the trainer to significantly increased swing speeds in a game condition swing.

SUMMARY OF THE INVENTION

In accordance with the invention, a swing speed trainer is provided which enables an athlete to significantly increase the athlete's swing speed with a conventional golf club, baseball bat, tennis racquet or other ball-striking implement.

In one golf swing embodiment, the trainer has a straight shaft with a golf grip on one end of the shaft and a spherical weight on the other end of the shaft. The shaft is sufficiently rigid to maintain its straightness with a slight static bow when the trainer is held by the grip in a stationary horizontal position and sufficiently flexible to elastically deform to a greater dynamic bow when the trainer is held by the grip and swung. In this embodiment, a static bow having a deflection in a range of 1.75 to 2.75% of the length of the shaft and a dynamic bow having a maximum deflection in a range of 30-40% of the length of the shaft are preferred. The shaft elasticity and the weight are coordinated to produce a "swoosh" sound when the trainer is swung with a correct golf swing at a high speed.

In another golf swing embodiment, the trainer has a straight shaft with a golf grip on the upper end of the shaft and a cap on the lower end of the shaft. The shaft is sufficiently rigid to maintain its straightness with a slight static bow when the trainer is held by the grip in a stationary horizontal position and sufficiently flexible to elastically deform to a greater dynamic bow when the trainer is held by the grip and swung. In this embodiment, a static bow having a deflection in a range of 1.75 to 2.75% of the length of the shaft and a dynamic bow having a maximum deflection in a range of 30-40% of the length of the shaft are preferred. The shaft elasticity and the weight are coordinated to produce a "swoosh" sound when the trainer is swung with a correct golf swing at a high speed. A spherical weight slides on the shaft between the grip and the cap. The weight is held in an upper position on the shaft and released from the upper position in response to centrifugal force generated during a downswing of the trainer to strike against the cap at substantially a ball striking position of the trainer. Preferably, the weight is held in the upper position by use of a first member fixed on the trainer proximate the lower end of the grip and a second member fixed to the weight, the members having a force of magnetic attraction holding the weight in the upper position.

In a baseball swing embodiment, the trainer has a straight shaft with a baseball bat grip on one end of the shaft and a cap on the other end of the shaft. A spherical weight slides on the shaft between the grip and the cap. The shaft is sufficiently rigid to maintain its straightness with a slight static bow when the trainer is held by the grip in a stationary horizontal position with the weight abutting the cap and sufficiently flexible to elastically deform to a greater dynamic bow when the trainer is held by the grip and swung. The weight abuts the grip with the trainer held in a conventional batting stance and slides in response to centrifugal force generated during a batting swing of the trainer to strike against the cap at substantially a ball striking position of the trainer in the swing. In this embodiment, the static bow has a deflection in a range of 1.75 to 2.75% of the length of the shaft and the dynamic bow has a maximum deflection in a range of 12-15% of the length of the shaft. The shaft elasticity and weight are coordinated to produce a "swoosh" sound when the trainer is swung with a correct baseball swing at a high speed.

In a tennis stroke embodiment, the trainer has a straight shaft with a tennis racquet grip on one end of said shaft and a cap on the other end of the shaft. The static bow has a deflection in a range of 1.75 to 2.75% of the length of the shaft and the dynamic bow has a maximum deflection in a range of 30-40% of the length of the shaft. The shaft elasticity and weight are coordinated to produce a "swoosh" sound when the trainer is swung with a correct tennis stroke at a high speed. A spherical weight slides on the shaft between the grip and the cap. The shaft is sufficiently rigid to maintain its straightness with a slight static bow when the trainer is held by the grip in a stationary horizontal position with the weight abutting the cap and sufficiently flexible to elastically deform to a greater dynamic bow when the trainer is held by the grip and swung. The weight abuts the grip with the trainer held in a conventional tennis ready position and slides in response to centrifugal force generated during a tennis stroke of the trainer to strike against the cap at substantially a ball striking position of the trainer in the stroke.

BRIEF DESCRIPTION OF THE DRAWINGS

Other objects and advantages of the invention will become apparent upon reading the following detailed description and upon reference to the drawings in which.

Figure 1:
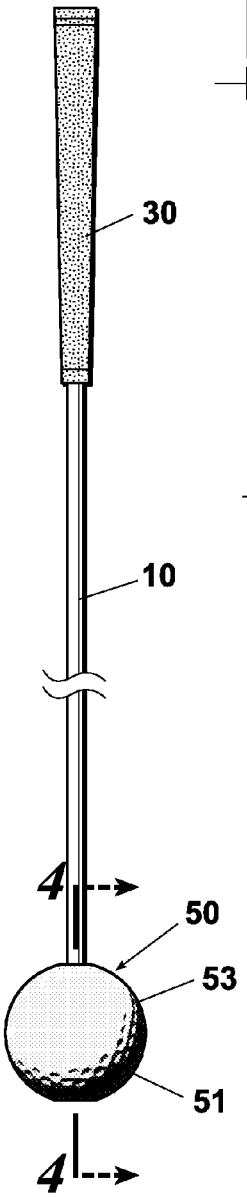
FIG. 1 is an elevation view of a fixed ball embodiment of a golf swing trainer.

While the invention will be described in connection with several embodiments thereof, it will be understood that it is not intended to limit the invention to those embodiments or to the details of the construction or arrangement of parts illustrated in the accompanying drawings.

DETAILED DESCRIPTION

The golf, baseball and tennis swing trainers hereinafter described are designed to permit an athlete to swing a trainer at speeds far in excess of the athlete's conventional or game condition swing speeds and to confirm to the athlete that the practice swings made with the trainer at these extremely high speeds have been technically properly executed. Armed with this experience, the athlete is then able to swing the athlete's own conventional club, bat or racquet at speeds which, though lower than the athlete's trainer swing speeds, are significantly higher than the athlete's previous conventional club swing speeds. After six or seven trainer swings, an athlete's swing speed with a conventional club, bat or racquet and the distance of travel of the associated projectile is typically increased in a range of 5 to 15%.

Golf Swing Trainer

The components of a golf swing can be broken down into proper swing plane, proper shaft rotation and maximum swing speed, all of which must be properly coordinated at the point of impact for greatest success. The purpose of the present golf swing trainer is to enable achievement of a golfer's maximum club head speed at the point of impact.

In the execution of a proper swing with a golf club, the club shaft experiences rearward deflection during the downswing so that the club head is trailing the grip as the club head approaches the point of impact with the ball. Maximum force will be applied to the ball if, when the golfer swings at the highest possible speed, the point of release of the shaft from rearward to forward deflection is coordinated with the swing plane and shaft rotation of the club so as to occur at impact with the ball.

Repetitive experience during practice of the different sensations that occur in the execution of such a high speed golf swing will help the golfer to execute that swing on the course. The repetition enables the golfer to develop a physical "sense" of the sequential occurrence of proper swing events as they are unfolding, a mental "recognition" of when a proper swing has been made and an emotional "anticipation" that the intended purpose of the swing is about to be visually enjoyed. Since the whole experience is physically, mentally and emotionally memorable, the golfer is much more likely to transfer that swing to a conventional club. The experience is reinforced by the trainer's "swoosh" sound when swung in so proper a manner as to generate a suitably high impact speed.

Fixed Ball Golf Trainer Embodiment

Turning first to FIGS. 1-4, a fixed ball embodiment of the trainer consists of a shaft 10 with a grip 30 on its upper end and, preferably, a weight 50 on its lower end.

The shaft 10 has a length 13 which is preferably in the range of shaft lengths used for conventional drivers, typically from 30 to 60" and as shown 48" and a constant diameter 11 in a range of approximately ¼ to 7/16", as shown 5/16", and is made of plastic, preferably a reinforced plastic such as fiberglass. The driver length is preferred for the trainer shaft 10 because it presents to the golfer the image of the longest and heaviest club in the golfer's bag. The ability to properly swing a trainer of conventional driver length and weight boosts the golfer's confidence in swinging a conventional driver as well as shorter or lighter conventional clubs. However, length alone is not a determinative factor of the structure of the trainer.

Figure 2:
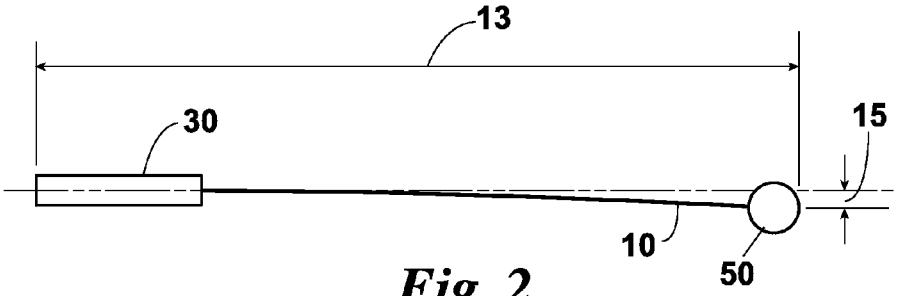
FIG. 2 is a graphic illustration of the static rigidity of the golf swing trainer of FIG. 1.
Figure 3:
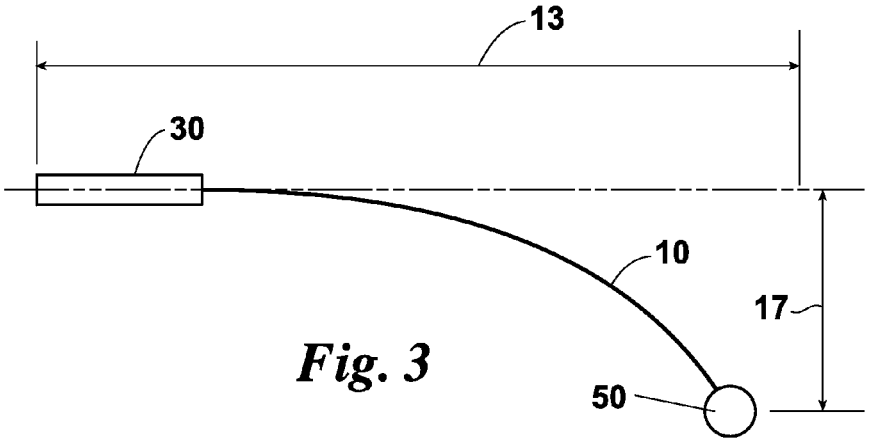
FIG. 3 is a graphic illustration of the dynamic elasticity of the golf swing trainer of FIG. 1.

Returning to FIG. 1, the fixed ball trainer has a straight shaft 10, a sports grip 30 and a spherical weight 50. As graphically illustrated in FIG. 2, the shaft 10 is sufficiently rigid to maintain its straightness, with the weight 50 on the shaft 10, distorted only to a slight static bow, that is when held by the grip 30 in a stationary horizontal orientation. As graphically illustrated in FIG. 3, the shaft 10 is sufficiently flexible to elastically deform to a greater dynamic bow, that is when held by the grip 30 and swung. As seen in FIG. 2, the static bow has a maximum deflection 15 in a range of 1.75 to 2.75% of the length 13 of the shaft 10. As seen in FIG. 3, the dynamic bow has a maximum deflection 17 in a range of 30-40% of the length 13 the shaft 10. These static/elastic characteristics are obtained using the empirically determined combination of length, diameter and material of the shaft 10 and the resulting trainer produces the audible "swoosh" in the desired swing speed range.

Looking again at FIG. 1, the grip 30 shown is a conventional golf club grip, but a practice grip molded to position the hands properly on the club could be used instead. Variations in the weights of known conventional and practice grips will have no significant impact on the "swoosh" performance of the trainer.

Continuing to look at FIG. 1, the weight 50 shown is spherical in shape 51 and preferably has an outer surface 53 textured to image the dimples of a golf ball, the object to be struck by the use of a conventional club associated with the sport. The shape 51 and surface texture 53 of the weight 50, and even the weight 50 itself, are not necessarily indispensible to the "swoosh" performance of the trainer. The magnitude of the weight 50 can be coordinated with the weight of the shaft 10 to result in a predetermined total weight of the trainer. If a weight 50 is attached to the shaft 10, it is preferably made of a resiliently compressible soft material able to absorb some impact with immovable objects such as floors or ceilings. Preferably, the weight 50 will be in a range of 30-180 grams and made of polyurethane foam. As shown, the weight 50 is a 2.75" diameter ball of polyurethane foam weighing in a range of 50-60 grams.

Figure 4:
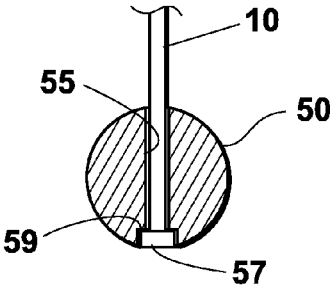
FIG. 4 is a cross-sectional view taken along the line 4-4 of FIG. 1.

As will be understood in reference to FIG. 4, to mount the weight 50 shown on the trainer, the lower end of the shaft 10 is inserted through a diametric hole 55 in the weight 50 which snugly grips the shaft 10. A metal cap 57 is glued to the lower end of the shaft 10. The lower end of the shaft 10 and the upper surface 59 of the cap 57 are coated with glue (not shown). The weight 50 is then slid down the shaft 10 into abutment against upper surface 59 of the cap 57 to hold the assembly together.

A trainer which combines a shaft 10 of the above empirically determined material, length and diameter with a weight 50 of the above diameter and mass produces the desired "swoosh" during proper high-speed swings. However, different empirically determined combinations will also result in a trainer which produces the desired audible "swoosh" when a proper swing is applied to the trainer. The above-described prototype is exemplary, having itself been empirically created and providing an audible "swoosh" comparator for evaluating future empirical prototypes. For the purposes of this disclosure, a suitable "swoosh" sound is produced by a trainer having a fiberglass shaft 10 of 48" length and 5/16" diameter and a weight 50 of 60 grams and 2.75" diameter when swung in a correct golf swing rhythm at a ball contact speed in a range of 80 to 150 mph. Any trainer having a shaft 10 of material, length and diameter, with or without a weight 50, resulting in a substantially equivalent sound when properly swung is structurally within the scope of this invention. Of those combinations producing the desired "swoosh" sound, the combination which has a total weight approximating the total weight of the user's driver is to be preferred.

In practicing with the trainer, the golfer merely swings the trainer as fast as possible. Because of its design, very much higher swing speeds can be achieved with the trainer than with a conventional club. The golfer's objective is to swing the trainer at or faster than the threshold speed for which the trainer is configured produce the audible success-confirming "swoosh." However, the trainer configuration requires that proper club head "release" must occur in order to accelerate through the point of impact sufficiently to achieve the "swoosh." If swinging as fast as possible does not produce the audible "swoosh" recognition, the golfer makes adjustments to the swing until the "swoosh" results. Once the "swoosh" has occurred, the golfer has a beginning point from which to continue swinging as fast as possible and adjusting the swing until the "swoosh" is achieved with regularity. The repetitive "swoosh" experience enables the golfer to "sense" the sequential occurrence of proper swing events and maximize the likelihood of repeating a proper high speed swing with a conventional club.

At the point of impact, that is the point of the swing where a conventional club head would strike a golf ball, if the trainer is swung at a speed producing the desired "swoosh" sound, the shaft 10, at approximately its center between the grip and the weight 50, will be bowed approximately 5 to 6" ahead of a line extending between the grip 30 and the weight 50.

Club head speeds for golfers averaging 65 to 75 strokes per round are typically in a range of 100 to 120 mph at point of impact, for golfers scoring between 75 and 85 in a range of 90 to 100 mph and for golfers scoring between 85 and 95 in a range of 75 to 90 mph. The material, length, diameter, rigidity and elasticity of the shaft 10 should be coordinated to provide the desired "swoosh" at a threshold swing speed which challenges the golfer's swing speed. As consistent swing speed increases over time, more challenging trainers should be used. The fixed ball prototype above described has a threshold "swoosh" speed of approximately 75 mph.

Before using the trainer, the inventor's average swing speed at point of contact was 105 mph for the inventor's driver. The inventor was able to swing the fixed ball trainer at average swing speeds at point of contact of 145 mph. After six consecutive swings properly completed with the fixed ball trainer in approximately seconds, the inventor was immediately able to swing the inventor's driver at average swing speeds at point of contact of 114 mph. At 3 yds/mph (the typical correlation of distance to swing speed), the 9 mph increase in club head speed at point of contact translates into an additional 27 yards per drive.

Sliding Ball Golf Trainer Embodiment

Figure 6:
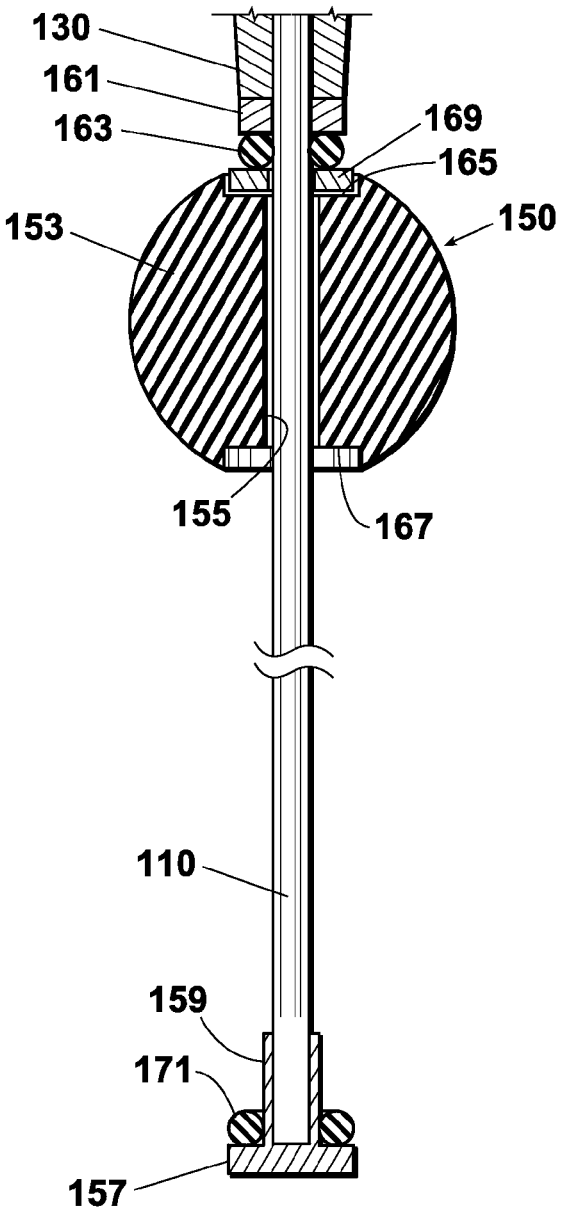
FIG. 6 is a cross-sectional view taken along the line 6-6 of FIG. 5.
Figure 5:
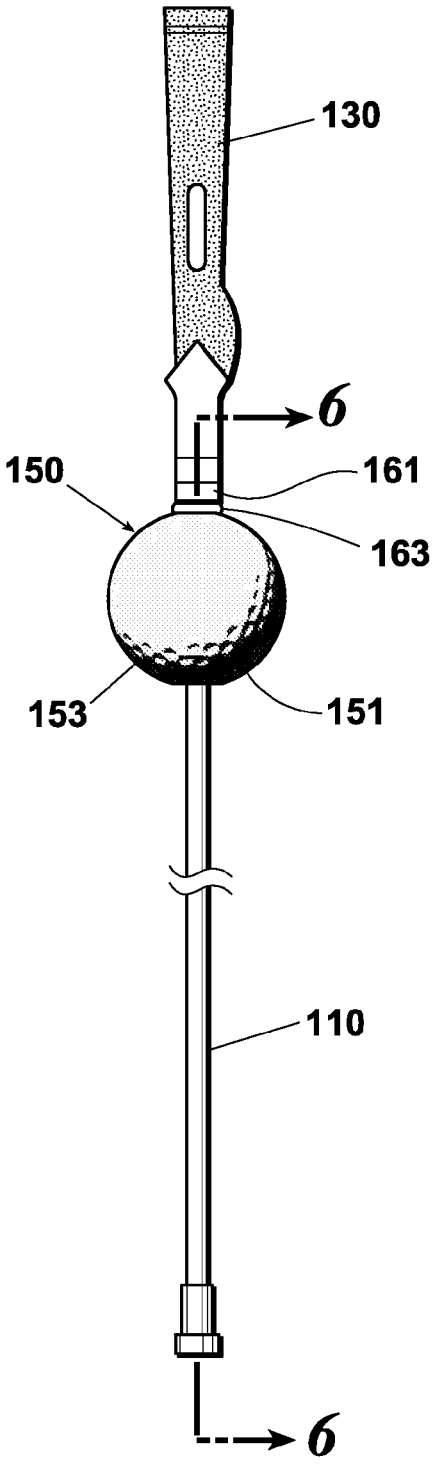
FIG. 5 is an elevation view of a sliding ball embodiment of a golf swing trainer at address.

Turning now to FIGS. 5-6, a sliding ball embodiment of the trainer has a shaft 110, a sports grip 130 and a spherical weight 150 which are compliant with the criteria set forth above with respect to the shaft 10, grip 30 and spherical weight 50 of the fixed ball embodiment except for modifications that, in the sliding ball embodiment, permit the spherical weight 150 to slide reciprocally on the shaft 110 between an address position in which the weight 150 abuts the bottom of the grip 130 and a point of impact position at which the weight 150 strikes the lower end cap 157 on the shaft 110.

The grip 130 shown is a practice grip molded to position the hands properly on the trainer, but a conventional grip 30 as seen on the fixed ball trainer could be used instead. Preferably, the outer surface 153 of the weight 150 is textured to image the dimples of a golf ball.

As seen in FIG. 5, and focusing primarily on the structural differences from the fixed ball embodiment, the sliding ball embodiment of the trainer includes a first metal ring 161 which is sized to slide over the lower end of the shaft 110 and is secured to and in abutment with the grip 130. A first resiliently compressible O-ring 163 is snugly fit over the shaft 110 and against the first metal ring 161. Looking at FIG. 6, the weight 150, unlike the weight 50 of the fixed ball embodiment, has a diametric hole 155 which permits the weight 150 to slide freely on the shaft 110. Diametrically opposed annular recesses 165 and 167 are concentrically disposed around the hole 155 in the surface 153 of the weight 150.

A second metal ring 169 is seated in the first recess 165 and glued to the weight 150. The shaft 110 extends through the second metal ring 169, the hole 155 and the lower recess 167 of the weight 150. The rings 161 and 169 are magnetically attracted, so that the weight 150 can be retained against the first O-ring 163. A metal cap 157 of diameter greater than the diameter of the diametric hole 155 through the weight 150 has a sleeve 159 which can slide freely into the hole 155 in the weight 150. A second resiliently compressible O-ring 171 snugly grips the sleeve 159 and seals against the greater diameter cap 157. The sleeve 159 slides snugly and is glued onto the end of the shaft 110. The force of magnetic attraction between the rings 161 and 169 is selected to hold the weight 150 against the first O-ring 161 if the trainer is in the address position but to release the weight 150 to the centrifugal force generated by the downswing.

Figure 7:
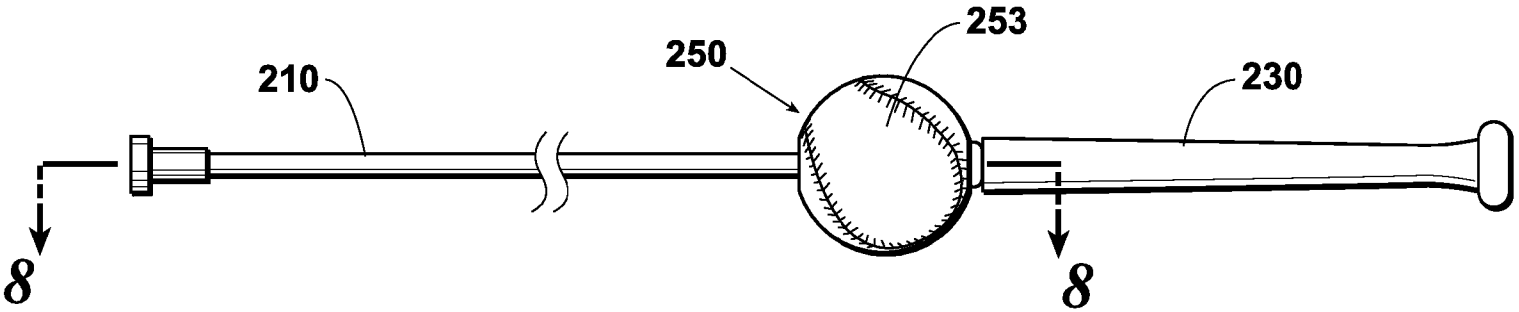
FIG. 7 is an elevation view of a sliding ball embodiment of a baseball swing trainer.

In practicing with the sliding ball trainer, the golfer slides the weight 150 up the shaft 110 until it is held against the O-ring 161 at the grip 130 by magnetic attraction. The golfer then swings the trainer as fast as possible, as with the fixed ball trainer. Very much higher swing speeds will be achieved with the trainer than with a conventional club. The golfer's objective is to swing the trainer at or faster than the threshold speed for which the trainer is configured to produce the audible success-confirming "swoosh." As with the fixed ball trainer, the sliding ball trainer also requires that proper club head "release" must occur in order to accelerate through the point of impact sufficiently to achieve the "swoosh." For the sliding ball embodiment of the trainer, the "swoosh" is slightly less pronounced than the "swoosh" of the fixed ball embodiment of the trainer. However, the sliding ball weight 150 is released by the centrifugal force of the downswing so that the sliding weight 150 strikes against the end cap 157, as seen in FIG. 7, providing an added momentary sound and a ball-striking feel which further aid the golfer in determining that maximum club head speed has occurred substantially at the point of impact. That is, if the momentary strike sound and feel occur significantly before or after the anticipated impact point, the golfer will more correctly be able to determine whether the hands have been released too early or too late, respectively. This enhances the ability of the golfer to "sense" the sequential occurrence of proper swing events and maximize the likelihood of repeating the proper high speed swing with a conventional club.

At the point of impact, that is the point of the swing where a conventional club head would strike a golf ball, if the trainer is swung at a speed producing the desired "swoosh" sound, the weight 150 will strike the cap 157 and the shaft 110, at approximately its center between the grip 130 and the weight 150, will be bowed approximately 5 to 6" ahead of a line extending between the grip 130 and the weight 150.

Baseball Swing Trainer

Figure 8:
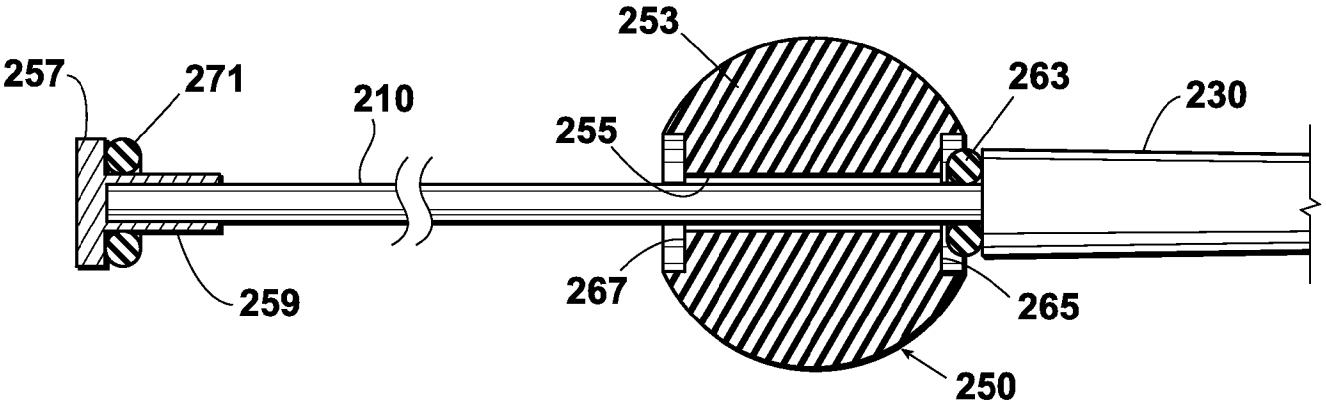
FIG. 8 is a cross-sectional view taken along the line 8-8 of FIG. 7.

Turning to FIGS. 7 and 8, a baseball swing trainer consists of a shaft 210 with a grip 230 on its upper end and, preferably, a weight 250 which slides on the shaft 210. The shaft 210 is sufficiently rigid to maintain its straightness, with the weight 250 on the shaft 210, distorted only to a slight static bow, that is when held by the grip 230 in a stationary horizontal orientation. The shaft 210 is sufficiently flexible to elastically deform to a greater dynamic bow, that is when held by the grip 230 and swung. The static bow has a maximum deflection in a range of 1.75 to 2.75% of the length of the shaft 210. The dynamic bow has a maximum deflection in a range of 12 to 15% of the length the shaft 210. These static/elastic characteristics are obtained using the empirically determined combination of length, diameter and material of the shaft 210 and the resulting trainer produces the audible "swoosh" in the desired swing speed range.

The shaft 210 shown has a length 213 which is in the range of typical baseball bat lengths of 30 to 40", a constant diameter 211 of 8 to 10 mm and is made of fiberglass. The preferred grip 230 shown is shaped like a conventional bat handle 231 with a knob 233. The weight and material of the handle will have no significant impact on the "swoosh" performance of the baseball trainer. The weight 250 is spherical in shape 251 and preferably has an outer surface 253 with seams imaging the seams of a baseball. The weight 250 is preferably made of a resiliently compressible soft material.

Preferably, the weight 250 will be in a range of 135 to 145 grams and made of hard foam covered by leather. As shown, the weight 250 is a 3" diameter ball of hard foam covered by leather weighing in a range of 135 to 145 grams.

As seen in FIG. 8, the sliding ball baseball swing trainer includes a first resiliently compressible O-ring 263 which snugly fits over the shaft 210 and against the grip 230. The weight 250 has a diametric hole 255 which permits the weight 250 to slide freely on the shaft 210. The shaft 210 extends through the weight 250 to a metal cap 257 of diameter greater than the diameter of the diametric hole 255. The cap 257 has a sleeve 259 which can slide freely into the hole 255 in the weight 250. A second resiliently compressible O-ring 271 snugly grips the sleeve 259 and seals against the greater diameter cap 257. The sleeve 259 slides snugly and is glued onto the end of the shaft 210.

In practicing with the sliding ball baseball trainer, the batter holds the trainer in a batting stance oriented so that the weight 250 slides on the shaft 210 until it is against the grip 230. The batter then swings the trainer as fast as possible. Because of its design, very much higher swing speeds can be achieved with the trainer than with a conventional bat. The batter's objective is to swing the trainer at or faster than the threshold speed for which the trainer is configured to produce the audible success-confirming "swoosh." The sliding ball trainer also requires that proper bat "release" must occur in order to accelerate through the point of impact sufficiently to achieve the "swoosh." The weight 250 is propelled to slide on the shaft 210 by the centrifugal force of the swing so that the sliding weight 250 strikes against the end cap 257, providing an added momentary sound and a ball-striking feel which aid the batter in determining that maximum bat speed has occurred at the point of impact. That is, if the momentary strike sound and feel occur before or after the anticipated impact point, the batter will more correctly be able to determine whether the hands have been released too early or too late, respectively. This enhances the ability of the batter to "sense" the sequential occurrence of proper swing events and maximize the likelihood of repeating the proper high speed swing with a conventional bat.

At the point of impact, that is the point of the swing where a conventional bat would strike a baseball, if the trainer is swung at a speed producing the desired "swoosh" sound, the weight 250 will strike the cap 257 and the shaft 210, at approximately its center between the grip 230 and the weight 250, will be bowed approximately 5 to 6" ahead of a line extending between the grip 230 and the weight 250.

Bat head speeds for batters range from 70 to 90 mph for professionals, from 60 to 80 mph for teenagers and from 40 to 60 mph for little league players. The material, length, diameter, rigidity and elasticity of the shaft 70 should be coordinated to provide the desired "swoosh" at a threshold swing speed which challenges the batter's swing speed. As consistent swing speed increases over time, more challenging trainers should be used. The prototype batting trainer above described has a threshold "swoosh" speed of approximately 40 mph.

Tennis Trainer

Figure 10:
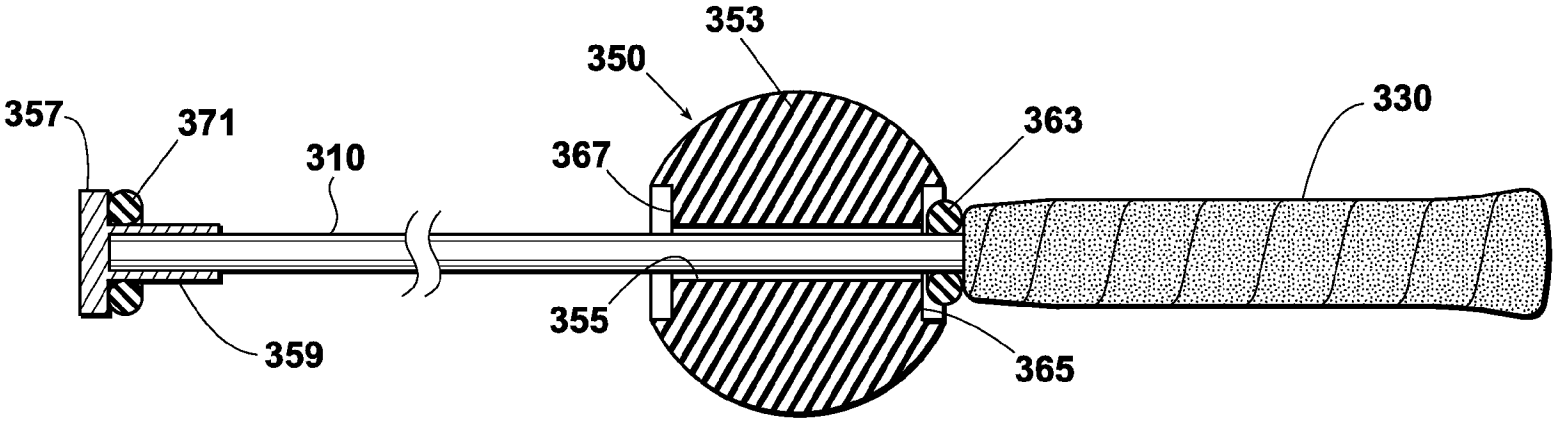
FIG. 10 is a cross-sectional view taken along the line 10-10 of FIG. 9.
Figure 9:
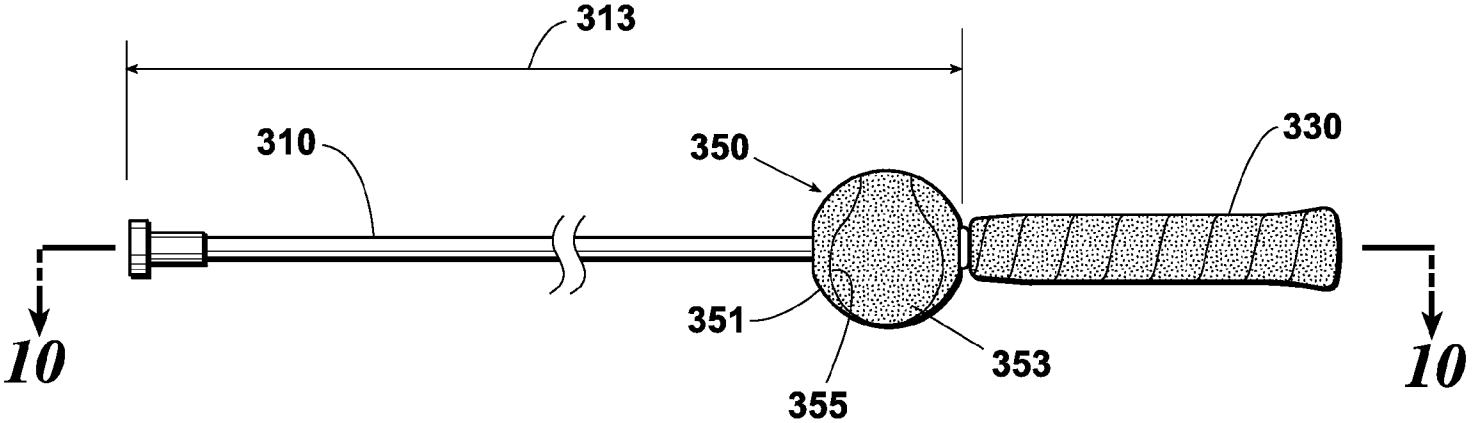
FIG. 9 is an elevation view of an embodiment of a tennis stroke trainer at the ready position.

Turning to FIGS. 9 and 10, a tennis stroke trainer consists of a shaft 310 with a grip 330 on its upper end and, preferably, a weight 350 which slides on the shaft 310. The shaft 310 is sufficiently rigid to maintain its straightness, with the weight 350 on the shaft 310, distorted only to a slight static bow, that is when held by the grip 330 in a stationary horizontal orientation. The shaft 310 is sufficiently flexible to elastically deform to a greater dynamic bow, that is when held by the grip 330 and swung. The static bow has a maximum deflection in a range of 1.75 to 2.75% of the length of the shaft 310. The dynamic bow has a maximum deflection in a range of 30 to 40% of the length the shaft 310. These static/elastic characteristics are obtained using the empirically determined combination of length, diameter and material of the shaft 310 and the resulting trainer produces the audible "swoosh" in the desired swing speed range.

The shaft 310 shown has a length 313 which is in the range of typical tennis racquet lengths of 20 to 30", a constant diameter 311 of 8 mm and is made of fiberglass. The preferred grip 330 shown is shaped like a conventional tennis racquet handle 331. The weight and material of the handle will have no significant impact on the "swoosh" performance of the tennis trainer. The weight 350 is spherical in shape 351 and preferably has an outer surface 353 with seams 355 imaging the seams of a tennis ball. The weight 350 is preferably made of a resiliently compressible soft material.

Preferably, the weight 350 will be in a range of 50 to 60 grams and made of rubber. As shown, the weight 350 is a 2.7" diameter ball of rubber weighing in a range of 50 to 60 grams.

As seen in FIG. 10, the tennis stroke trainer includes a first resiliently compressible O-ring 363 which snugly fits over the shaft 310 and against the grip 330. Looking at FIG. 6, the weight 350 has a diametric hole 355 which permits the weight 350 to slide freely on the shaft 310. The shaft 310 extends through the weight 350 to a metal cap 357 of diameter greater than the diameter of the diametric hole 355. The cap 357 has a sleeve 359 which can slide freely into the hole 355 in the weight 350. A second resiliently compressible O-ring 371 snugly grips the sleeve 359 and seals against the greater diameter cap 357. The sleeve 359 slides snugly and is glued onto the end of the shaft 310.

In practicing with the sliding ball tennis trainer, the athlete holds the trainer in a tennis ready stance oriented so that the weight 350 slides on the shaft 310 until it is against the grip 330. The athlete then swings the trainer as fast as possible. Because of its design, very much higher swing speeds can be achieved with the trainer than with a conventional tennis racquet. The athlete's objective is to swing the trainer at or faster than the threshold speed for which the trainer is configured to produce the audible success-confirming "swoosh." The sliding ball trainer also requires that proper racquet "release" must occur in order to accelerate through the point of impact sufficiently to achieve the "swoosh." The weight 350 is propelled to slide on the shaft 310 by the centrifugal force of the swing so that the sliding weight 350 strikes against the end cap 357, providing an added momentary sound and a ball-striking feel which aid the athlete in determining that maximum racquet speed has occurred at the point of impact. That is, if the momentary strike sound and feel occur before or after the anticipated impact point, the athlete will more correctly be able to determine whether the hand has been released too early or too late, respectively. This enhances the ability of the athlete to "sense" the sequential occurrence of proper swing events and maximize the likelihood of repeating the proper high speed swing with a conventional racquet.

At the point of impact, that is the point of the swing where a conventional tennis racquet would strike a tennis ball, if the trainer is swung at a speed producing the desired "swoosh" sound, the weight 350 will strike the cap 357 and the shaft 310, at approximately its center between the grip 330 and the weight 350, will be bowed approximately 5 to 6" ahead of a line extending between the grip 330 and the weight 350.

Racquet speeds for athletes range from 75 to 85 mph for professionals, from 60 to 75 mph for teenagers and from 45 to 60 mph for children. The material, length, diameter, rigidity and elasticity of the shaft 310 should be coordinated to provide the desired "swoosh" at a threshold swing speed which challenges the athlete's swing speed. As consistent swing speed increases over time, more challenging trainers should be used. The tennis stroke trainer above described has a threshold "swoosh" speed of approximately 30 mph.

Tennis Serve Swing Trainer

Throughout a golf swing the ball is stationary, so the point of impact is not only intuitive but permanent. In a baseball swing, the ball and the bat are moving in a generally horizontal plane and the point of impact is intuitively chosen by the batter according to the direction in which the batter intends the ball to travel after it is struck. For a right handed hitter, the earlier in the swing impact with the ball occurs, the more toward the left field foul line the ball will travel. The later in the swing impact with the ball occurs, the more toward the right field foul line the ball will travel. In tennis ground strokes, assuming the task is to return a ball travelling on an essentially horizontal path from an opponent's racquet, the intuitive point of impact of the racquet with the ball is similarly determined in relation to the direction in which the player intends the ball to travel after it is struck. In all of these swings, the intended point of impact is intuitive to the player. The objectives of the sliding-ball golf, baseball and tennis swing speed trainers hereinbefore discussed are two-fold. The first objective is to maximize swing speed at the intuitive point of intended impact of a club, bat or racquet with a ball. The second objective is to indicate to a player swinging the trainer whether the swing with the trainer would have caused such a result in actual play. Accordingly, the shaft lengths and ball weights of the above described sliding-ball trainers are coordinated to cause the sliding ball of the trainer to strike the trainer end cap at the moment the swing position of the trainer mirrors the intuitive impact point of a real club, bat or racquet with the ball.

However, it has been found that, while a tennis swing speed trainer correctly designed in accordance with the above-described invention is suitable for practicing non-service tennis strokes, the same trainer is counterproductive in practicing tennis service strokes. This is so because the point of impact of the racquet with the ball during a tennis serve is not intuitive.

In typical service fashion, the ball is tossed high above the server's head at the baseline and the natural instinct of the player is to hit down on the ball and drive it into the service court on the other side of the net. Almost all tennis players intuitively try to hit down on the ball when they serve. However, when the server hits down on the ball, the arm is already beginning to bend and the racquet head is actually decelerating at the point of impact, so maximum ball speed cannot be achieved. Furthermore, the angle of attack on the ball is not ideal and, if the racquet head and the ball do not meet at the proper angle, the result is inconsistency in service shots. Not only are service speed and accuracy compromised by the intuitive hit-down striking motion, but the hit-down striking motion also puts added strain on the tendons and ligaments of the server's shoulder and arm.

The best tennis serving motion is counter-intuitive. If the ball is struck at the apex of the upward portion of the swing, the arm is fully extended, the racquet head speed is accelerated to its maximum, the angle of attack is ideal, the ball and the racquet meet at the perfect impact point at the apex of the serve, and a snap in the racquet motion happens automatically at the top of the swing. The result, more often than not, is a great serve.

But intuition is a powerful and controlling force so, even for top-ranked professional tennis players, learning the more effective counter-intuitive serving motion of hitting up on the ball is very difficult. And, even for the best coaches in the world, teaching the more effective counter-intuitive serving motion of hitting up on the ball is very difficult. Practicing thousands of actual serves with real tennis balls and real tennis racquets, watching hours of video analysis of those serves and even hearing a personal professional coach describe the perfect serve over and over again generally does not work, even for the most gifted of athletes.

Intuition trumps imagination and the likely result is that practice repeats the intuitive hitting-down-on-the-ball service swing, reinforcing precisely the technique that needs to be broken down. But there is no known mechanical device that helps to teach and to execute the counter-intuitive hitting-up-on-the-ball tennis serve.

The present tennis serve trainer 400 mechanically encourages and causes the execution of the counter-intuitive service swing. By repetitive swings with the trainer 400, the proper serving motion is easily learned and can be repeated with a standard racquet.

Figure 11:
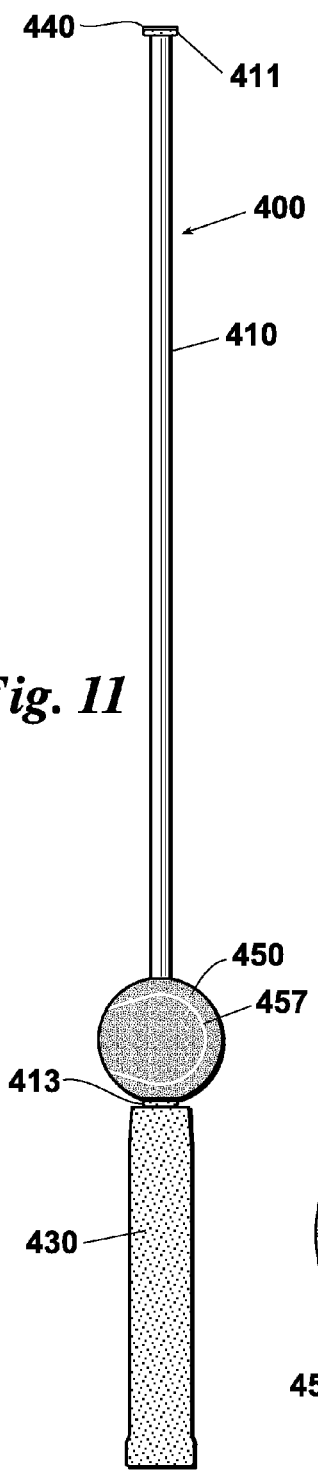
FIG. 11 is an elevation view of a sliding ball tennis serve swing trainer.
Figure 13:
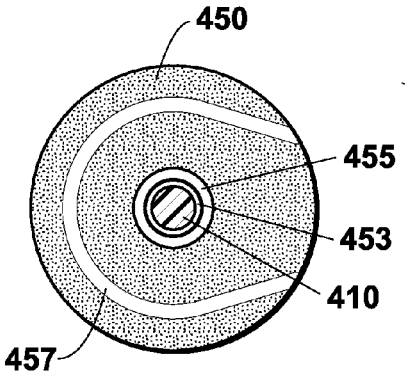
FIG. 13 is a cross-sectional view taken along the line 13-13 of FIG. 12.
Figure 12:
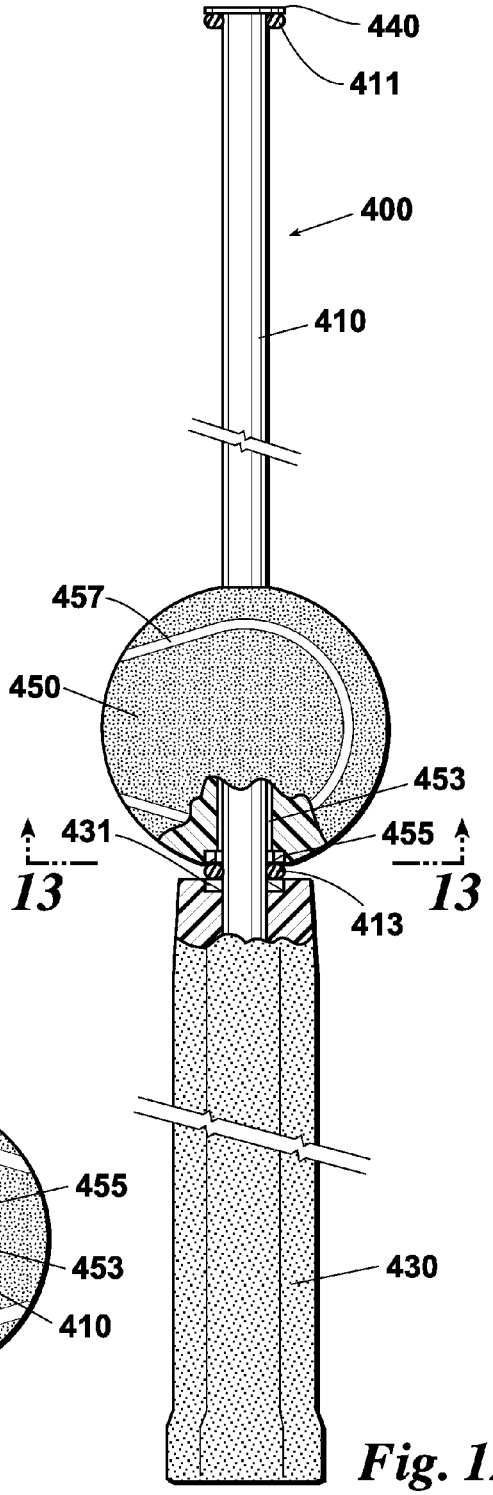
FIG. 12 is an enlarged elevation view with parts broken away of the trainer of FIG. 11.

Looking at FIGS. 11-13, the tennis serve trainer 400 has a straight shaft 410 with a tennis racquet grip 430 on one, or proximal, end of the shaft 410 and an end cap 440 on the other, or distal, end of the shaft 410. A ball 450 has a cylindrical passageway 451 aligned on its center axis. The cylindrical passageway 451 defines an annulus 453 between the shaft 410 and the ball 450 and permits the ball 450 to freely slide on the shaft 410 between the grip 430 and the end cap 440. A steel washer 431 is mounted concentrically about the shaft 410 at the inward end of the grip 430 and a washer-shaped magnet 455 is mounted on the ball 450 concentrically about the end of the passageway 451 closest to the grip 430. O-rings 411 and 413 are positioned on the shaft 410 against the end cap 440 and the washer 431 to protect and absorb the impact of the sliding ball 450. The locations of the washer 431 and the magnet 455 on the trainer 400 can be reversed and the washer can itself be a magnet. As shown, the ball 450 preferably has the external appearance 457 of a tennis ball.

A sufficient force of magnetic attraction is afforded between the magnet 455 and the washer 431 to secure the ball 450 against the grip 430 until a threshold centrifugal force causes the ball 450 to be released from the grip 430. The appropriate release point may be empirically determined. The release point, the length of the shaft 410 from the grip 430 to the end cap 440 and the weight of the sliding ball 450 are coordinated so that, when the sliding ball 450 is released from the grip 430, the ball 450 will slide rapidly up the shaft 410 and strike the end cap 440 of the trainer 400 not later than, and preferably at, the apex of the serve. The force of the sliding ball 450 moving up the shaft 410 and striking the end cap 440 encourages and causes the user to hit up-on-the-ball in repetitive practice swings, enabling dramatically improved actual service swings in a matter of minutes.

Figure 15:
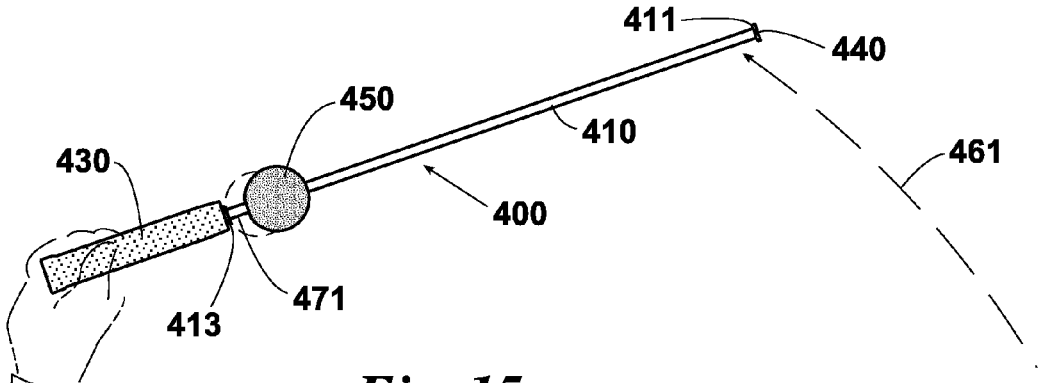
FIG. 15 is an elevation view of a sliding ball tennis serve upswing of the trainer of FIG. 11 with the shaft approximately 20° above horizontal and the sliding ball initially released from the grip toward the end cap.
Figure 14:
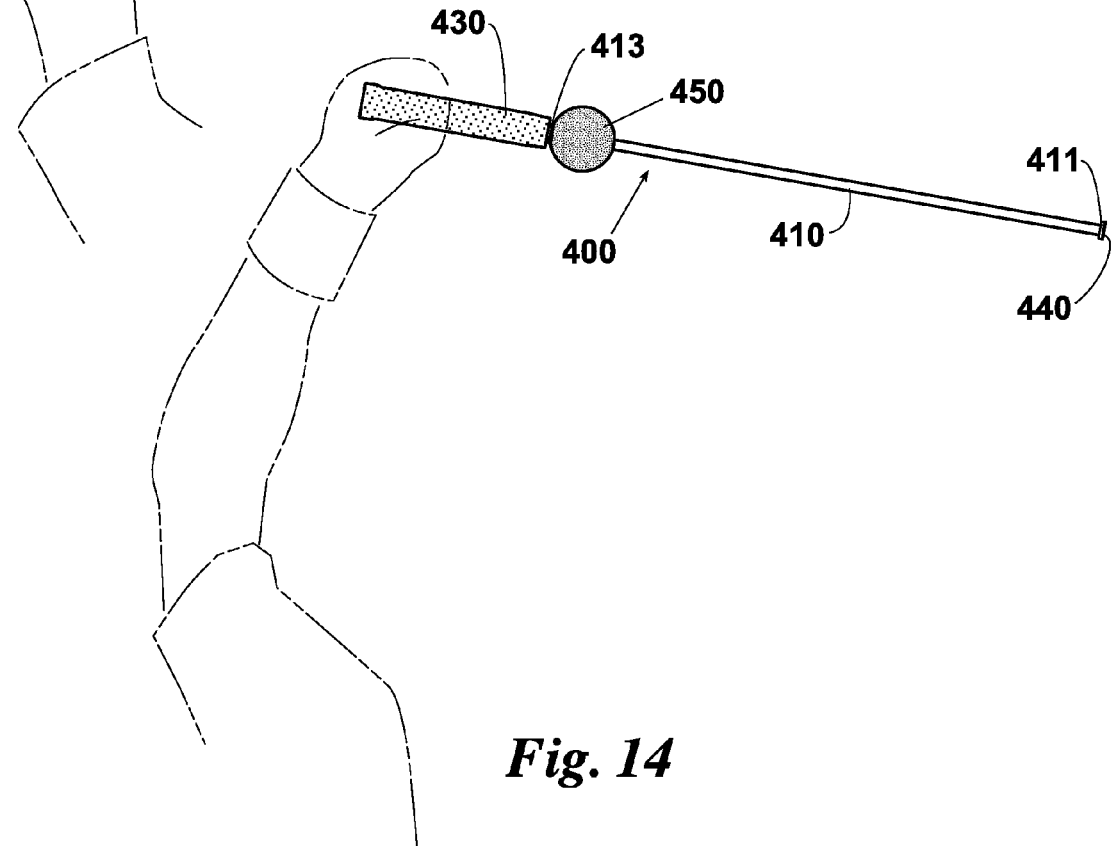
FIG. 14 is an elevation view of a sliding ball tennis serve upswing of the trainer of FIG. 11 with the shaft approximately 10° below horizontal and the sliding ball not yet released from the grip.
Figure 17:
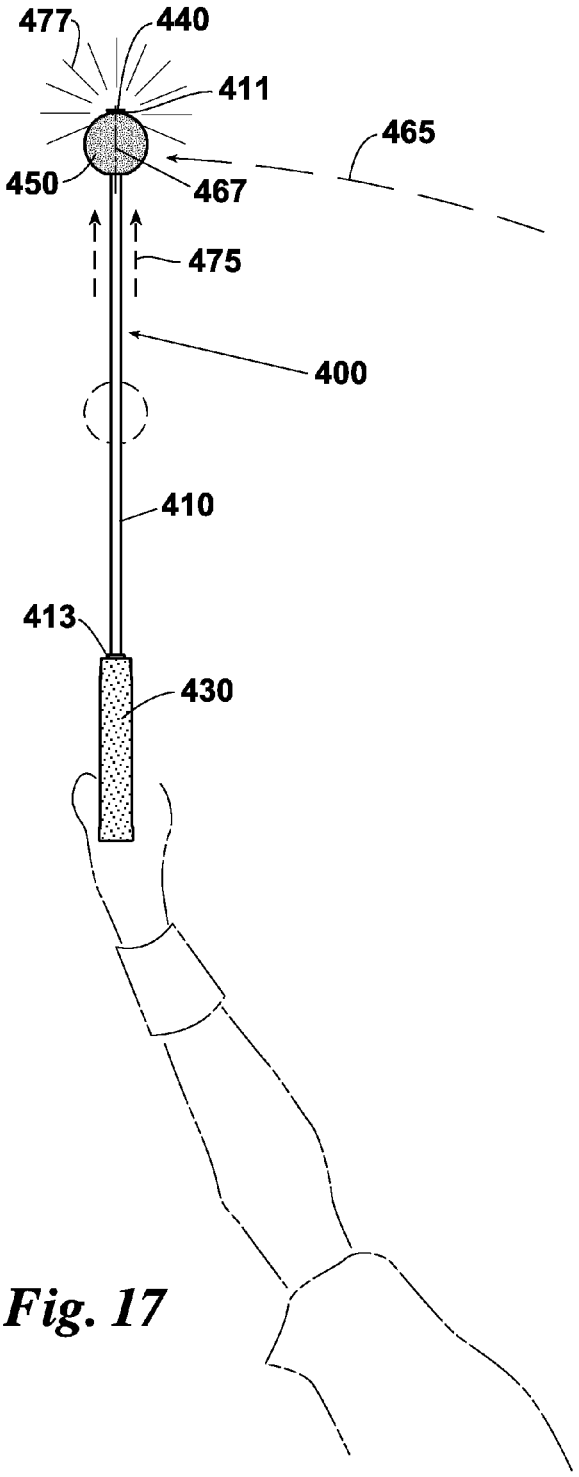
FIG. 17 is an elevation view of a sliding ball tennis serve upswing of the trainer of FIG. 11 with shaft approximately and not more than 90° above horizontal and the sliding ball striking the end cap.
Figure 16:
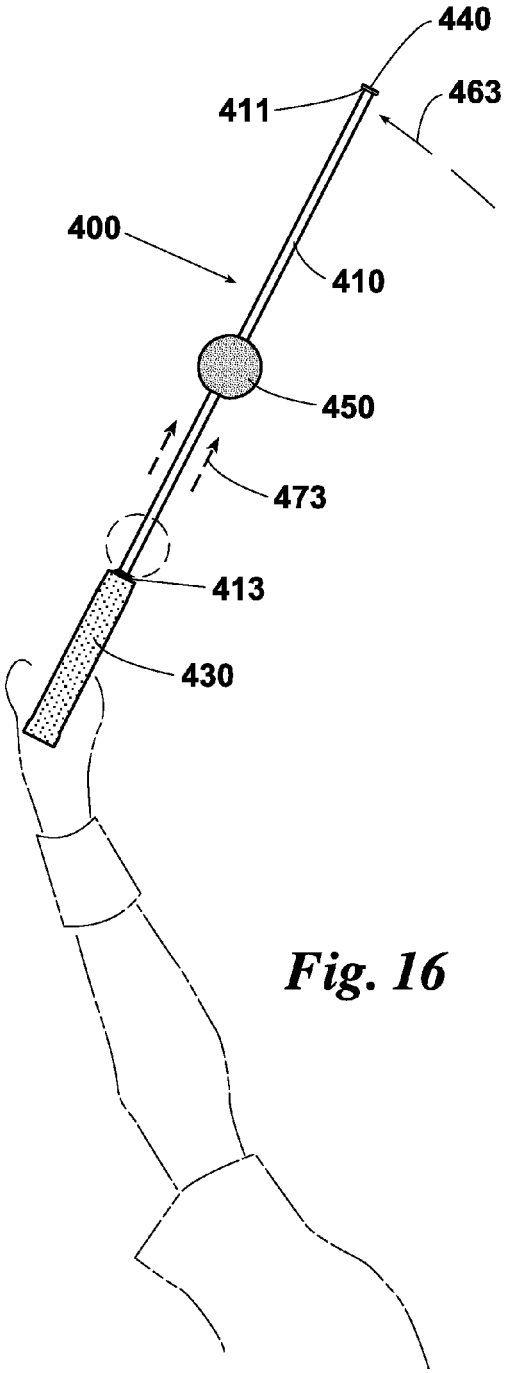
FIG. 16 is an elevation view of a sliding ball tennis serve upswing of the trainer of FIG. 11 with the shaft approximately 65° above horizontal and the sliding ball nearing the mid-point between the grip and the end cap.

Looking at FIGS. 14-17, consecutive stages of the upswing of a swing serve using the trainer 400 are illustrated. In FIG. 14, the trainer 400 is below horizontal, the threshold centrifugal force on the ball 450 is not yet achieved, and the ball 450 remains held against the O-ring 431 at the grip 430 by the magnetic attraction between the washer 431 and the magnet 455. In FIG. 15, the trainer 400 has been swung 461 above horizontal and the threshold centrifugal force on the ball 450 has been exceeded so that the ball 450 has been released from the O-ring 431 at the grip 430 and has begun to slide and accelerate 471 toward the end cap 440. In FIG. 16, the trainer 400 has been further swung at increasing acceleration 463 toward vertical and the sliding ball 450 continues its slide and acceleration 473 toward the end cap 440. In FIG. 17, the trainer 400 has been substantially swung at continually increasing acceleration 465 to a maximum speed which, if consistent with the maximum design swing speed of the trainer 400, results in the sliding ball 450 continuing its slide and acceleration 475 and striking 477 the end cap 440 at the apex 467 of the swing 467.

If the sliding ball 450 hits the end cap 440 before the apex of the serve, the user will know that the swing has not reached the target, or maximum design-swing-speed, of the trainer 400. For a properly executed swing, the user will feel a "pop" when the sliding ball 450 strikes 477 the end cap 440 at the very apex 467 of the upward portion of the service swing. The "pop at the top" confirms delivery of maximum racquet head speed on the upswing at the counter-intuitive apex impact point. If the sliding ball 450 hits the end cap 440 after the apex of the serve, the user will know that the swing would have struck a real tennis ball in the intuitive hit-down-on-the-ball fashion rather than in the desired hit-up-on-the-ball fashion.

Looking again at FIGS. 11-13, a functional prototype of the tennis serve trainer 400 may have an 8-10 mm diameter fiberglass shaft 410 with a standard tennis racquet grip 430 on its proximal end and a 3 mm thick, one inch outer diameter steel cap 440 on its distal end. The sliding ball 450 is a 2¾" polyurethane foam sphere weighing 50-60 grams. The sliding ball 450 may have an 11-14 mm cylindrical passageway 451 aligned on its center axis. Typically, a 23 mm OD×16.5 mm ID×3 mm thick steel washer 431 is seated in the inward end of the grip 430 and a 23 mm OD×16.5 mm ID×3 mm thick magnet 455 is seated in the ball 450. The O-rings 411 and 413 are typically 1" OD×0.375" ID×5 mm thick rubber. The O-ring thickness determines the minimal spacing between the washer 431 and the magnet 455, and thicker O-rings 413 are used to increase the minimal spacing and thus decrease the threshold magnetic force as required. The shaft distance from washer 431 to end cap 440 is typically 24". The above dimensions and materials are exemplary. Other dimensions and materials may also function satisfactorily, provided the release point, the length of the shaft 410 from grip 430 to end cap 440 and the weight of the sliding ball 450 are coordinated to cause the sliding ball 450 to strike the end cap 440 of the trainer 400 not later than, and preferably at, the apex of the serve upswing. The determination of the dimensions and materials may be the result of an empirical process.

Thus, it is apparent that there has been provided, in accordance with the invention, a swing speed trainer that fully satisfies the objects, aims and advantages set forth above. While the invention has been described in conjunction with specific embodiments thereof, it is evident that many modifications and variations will be apparent to those skilled in the art and in light of the foregoing description. Accordingly, it is intended to embrace all such alternatives, modifications and variations as fall within the spirit of the appended claims.

What is claimed is:

1. A tennis service swing trainer comprising:

a shaft;

a grip on one end of said shaft;

a cap on another end of said shaft; and a ball having a cylindrical passageway aligned on a center axis thereof, said passageway permitting said ball to freely slide on said shaft between said grip and said cap;

a steel washer mounted at the inward end of said grip; and a washer-like magnet mounted on said ball, said magnet and said washer having sufficient force of magnetic attraction therebetween to secure said ball against said grip until a threshold centrifugal force causes said ball to be released from said grip;

said force of magnetic attraction, a length of said shaft from said grip to said cap and a weight of said ball being coordinated so that a service swing of the trainer executed at a maximum design speed of the trainer causes said ball to strike against said cap not later than at an upward apex point of travel of the trainer during the tennis service swing.

2. A tennis swing trainer according to claim 1, said grip comprising a tennis racquet grip.

3. A tennis swing trainer according to claim 1 further comprising an annulus between said shaft and said ball.

4. A tennis swing trainer according to claim 1, said steel washer being mounted concentrically about said shaft at an inward end of said grip.

5. A tennis swing trainer according to claim 1, said washer-like magnet being mounted on said ball concentrically about an end of said passageway closest to said grip.

6. A tennis service swing trainer comprising:

a straight shaft;

a tennis racquet grip on one end of said shaft;

a cap on another end of said shaft; and a ball having a cylindrical passageway aligned on a center axis thereof and defining an annulus between said shaft and said ball, said passageway permitting said ball to freely slide on said shaft between said grip and said cap;

a steel washer mounted concentrically about said shaft at the inward end of said grip; and a washer-like magnet mounted on said ball concentrically about an end of said passageway closest to said grip, said magnet and said washer having sufficient force of magnetic attraction therebetween to secure said ball against said grip until a threshold centrifugal force causes said ball to be released from said grip;

said force of magnetic attraction, a length of said shaft from said grip to said cap and a weight of said ball being coordinated so that a service swing of the trainer executed at a maximum design speed of the trainer causes said ball to strike against said cap not later than at an upward apex point of travel of the trainer during the tennis service swing.

7. A tennis service swing trainer comprising:

a shaft;

a grip on one end of said shaft;

a cap on another end of said shaft; and an object having a cylindrical passageway aligned on a center axis thereof, said passageway permitting said object to freely slide on said shaft between said grip and said cap;

a steel washer mounted at the inward end of said grip; and a washer-like magnet mounted on said object, said magnet and said washer having sufficient force of magnetic attraction therebetween to secure said object against said grip until a threshold centrifugal force causes said object to be released from said grip;

said force of magnetic attraction, a length of said shaft from said grip to said cap and a weight of said object being coordinated so that a service swing of the trainer executed at a maximum design speed of the trainer causes said object to strike against said cap not later than at an upward apex point of travel of the trainer during the tennis service swing.

* * * * *